US005493373A

United States Patent [19]

Gundlach et al.

[11] Patent Number: 5,493,373

[45] Date of Patent: Feb. 20, 1996

[54] METHOD AND APPARATUS FOR IMAGING ON A HEATED INTERMEDIATE MEMBER

[75] Inventors: Robert W. Gundlach, Victor; Christopher Snelling, Penfield; Henry R. Till, East Rochester, all of N.Y.

[73] Assignee: Xerox Corporation, Stamford, Conn.

[21] Appl. No.: 316,017

[22] Filed: Sep. 30, 1994

Related U.S. Application Data

[63] Continuation-in-part of Ser. No. 55,331, May 3, 1993, Pat. No. 5,353,105.

[51] Int. Cl.[6] ..... G03G 15/01

[52] U.S. Cl. ..... 355/279; 355/326 R; 347/115; 347/156; 430/42

[58] Field of Search ..... 355/271, 279, 355/285–290, 202, 328; 430/124, 126, 42; 219/2.6; 347/115, 120, 155, 156

[56] References Cited

U.S. PATENT DOCUMENTS

| | | | |
|---|---|---|---|
| 2,968,552 | 1/1961 | Gundlach . | |
| 3,013,878 | 12/1961 | Dessauer . | |
| 3,374,769 | 3/1968 | Carlson | 430/124 X |
| 3,591,276 | 7/1971 | Byrne | 430/126 |
| 3,669,706 | 6/1972 | Sanders et al. . | |
| 3,689,935 | 9/1972 | Presman et al. . | |
| 3,794,418 | 2/1974 | Makino et al. | 355/220 |
| 3,848,204 | 11/1974 | Draugelis et al. | 355/277 |
| 3,957,367 | 5/1976 | Goel | 355/281 |
| 4,195,927 | 4/1980 | Fotland et al. | 355/277 |
| 4,267,556 | 5/1981 | Fotland et al. . | |
| 4,365,549 | 12/1982 | Fotland et al. . | |
| 4,373,799 | 2/1983 | Snelling et al. | 355/202 |
| 4,427,285 | 1/1984 | Stange | 355/288 |
| 4,446,471 | 5/1984 | Yano | 347/151 |
| 4,448,872 | 5/1984 | Vandervalk | 430/126 |
| 4,463,363 | 7/1984 | Gundlach et al. . | |
| 4,518,468 | 5/1985 | Fotland et al. . | |
| 4,619,515 | 10/1986 | Maczuszenko et al. . | |
| 4,697,195 | 9/1987 | Quate et al. . | |
| 4,745,419 | 5/1988 | Quate et al. . | |
| 4,860,036 | 8/1989 | Schmidlin . | |
| 4,935,785 | 6/1990 | Wildi et al. . | |
| 5,087,946 | 2/1992 | Dalal et al. . | |
| 5,153,615 | 10/1992 | Snelling . | |
| 5,168,289 | 12/1992 | Katakabe et al. . | |
| 5,175,568 | 12/1992 | Oyamaguchi et al. . | |
| 5,185,619 | 2/1993 | Snelling . | |
| 5,191,381 | 3/1993 | Yuan | 355/285 |
| 5,198,842 | 3/1993 | Fujino et al. | 347/120 |
| 5,233,397 | 8/1993 | Till | 355/279 |

FOREIGN PATENT DOCUMENTS

| | | | |
|---|---|---|---|
| 59-125766 | 7/1984 | Japan | 355/271 |
| 4-130393 | 5/1992 | Japan | 355/273 |

*Primary Examiner*—Joan H Pendegrass
*Attorney, Agent, or Firm*—Lloyd F. Bean, II

[57] ABSTRACT

The present invention is a method and apparatus for printing using an intermediate member acting as a receptor for marking particles representing an image. The marking particles may be deposited directly or indirectly on the member, after which time the member is exposed, via an internal heat source, to an elevated temperature sufficient to cause the melting and coalescing of the marking particles. Subsequently, the intermediate member is advanced so as to place the tackified marking particles present on the outer surface thereof into intimate contact with the surface of a recording sheet.

11 Claims, 5 Drawing Sheets

FIG. 3B
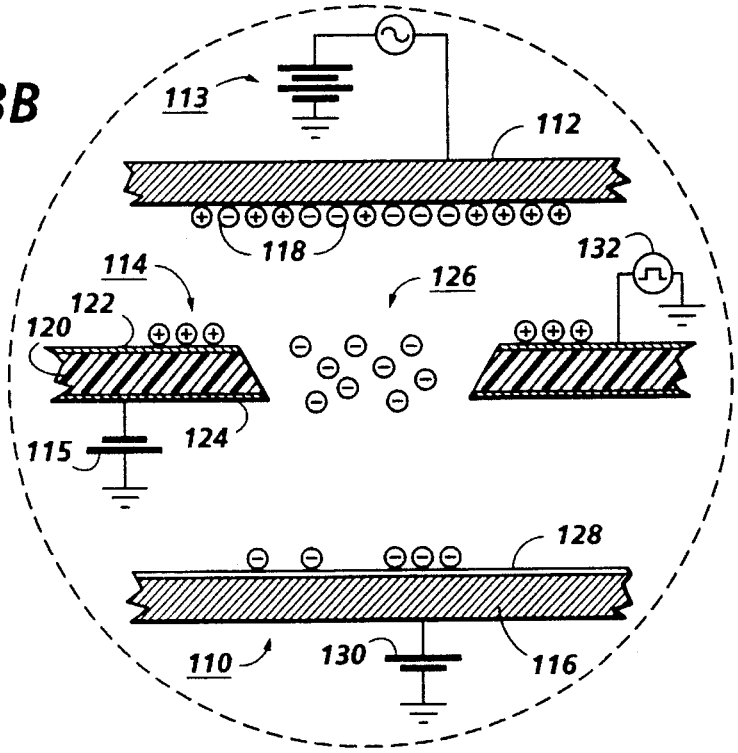
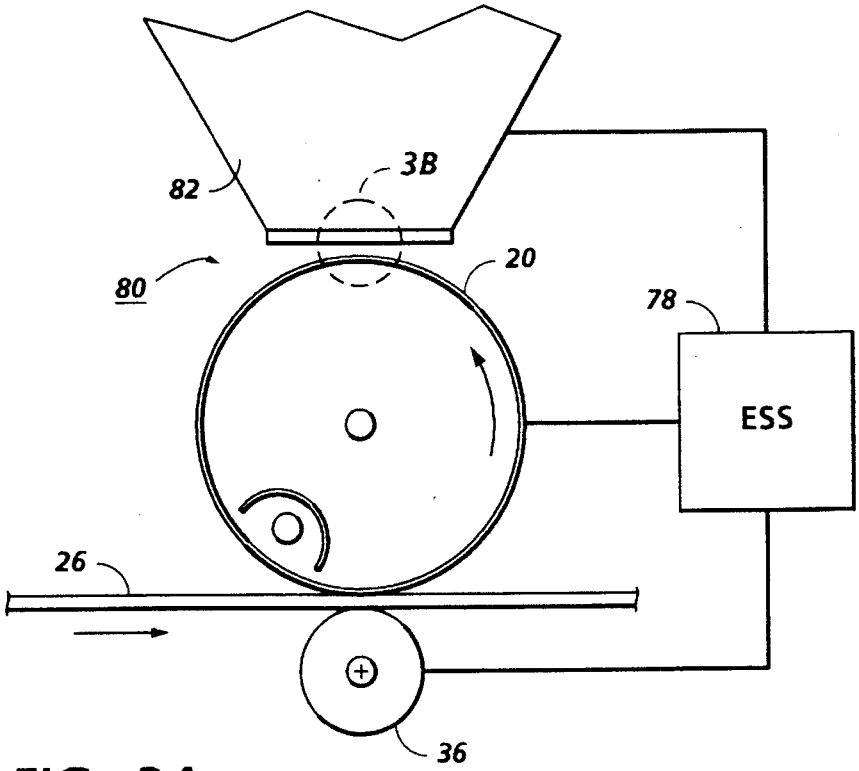
FIG. 3A

FIG. 5
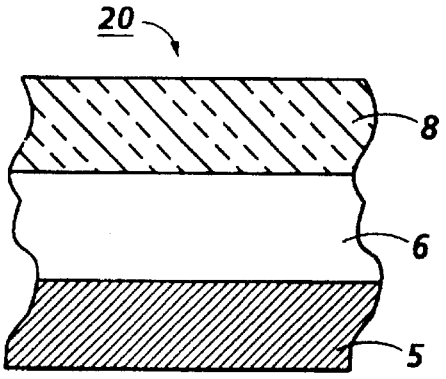
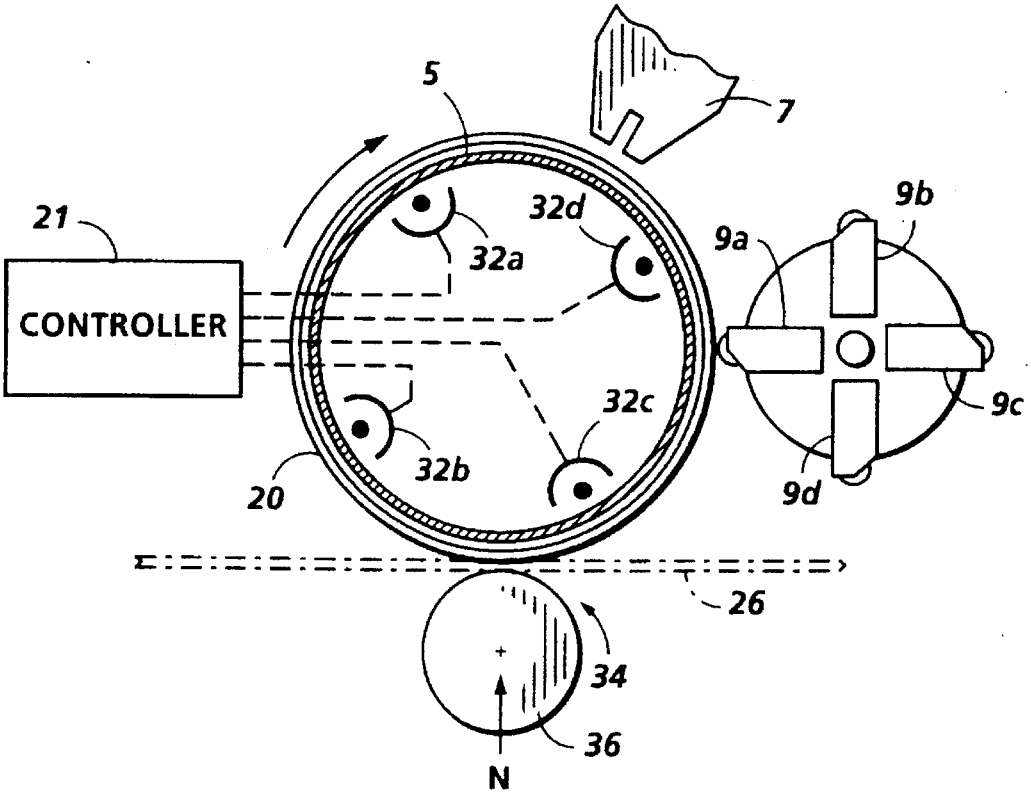
FIG. 6

METHOD AND APPARATUS FOR IMAGING ON A HEATED INTERMEDIATE MEMBER

This is a Continuation in Part Application of application Ser. No.: 08/055,331 filed May 3, 1993, now U.S. Pat. No. 5,353,105.

This invention relates generally to a non-impact printing system, and more particularly to a method and apparatus for producing a transferable image on a heated intermediate member and subsequently transferring the image to a recording sheet.

BACKGROUND AND SUMMARY OF THE INVENTION

The present invention capitalizes on the advantages inherent in recording images on an intermediate member and then transferring those images to a recording sheet or substrate. One primary advantage of such a system is the increased ability to control the critical spacing parameters in the transfer gap between the marking and/or development devices and the intermediate member. As is the case with most marking technologies, the characteristic variations inherent in the recording sheets requires the marking mechanisms to be developed with wide latitudes to accommodate such variations.

Heretofore, various marking methods have employed an intermediate member or have combined transfer-fixing (transfix) steps in the marking process, some being the subject of the following disclosures which may be relevant:

U.S. Pat. No. 3,013,878 Patentee: Dessauer Issued: Dec. 19, 1961

U.S. Pat. No. 3,374,769 Patentee: Carlson Issued: Mar. 26, 1968

U.S. Pat. No. 3,591,276 Patentee: Byrne Issued: Jul. 6, 1971

U.S. Pat. No. 3,794,418 Patentee: Makino et al. Issued: Feb. 26, 1974

U.S. Pat. No. 3,848,204 Patentee: Draugelis et al. Issued: Nov. 12, 1974

U.S. Pat. No. 4,195,927 Patentee: Fotland et al. Issued: Apr. 1, 1980

U.S. Pat. No. 4,267,556 Patentee: Fotland et al. Issued: May 12, 1981

U.S. Pat. No. 4,365,549 Patentee: Forland et al. Issued: Dec. 28, 1982

U.S. Pat. No. 4,373,799 Patentee: Snelling et al. Issued: Feb. 15, 1983

U.S. Pat. No. 4,427,285 Patentee: Stange Issued: Jan. 24, 1984

U.S. Pat. No. 4,448,872 Patentee: Vandervalk Issued: May 15, 1984

U.S. Pat. No. 4,518,468 Patentee: Fotland et al. Issued: May 21, 1985

U.S. Pat. No. 4,935,785 Patentee: Wildi et al. Issued: Jun. 19, 1990

U.S. Pat. No. 5,087,946 Patentee: Dalai et al. Issued: Feb. 11, 1992

U.S. Pat. No. 5,168,289 Patentee: Katakabe et al. Issued: Dec. 1, 1992

U.S. Pat. No. 5,175,568 Patentee: Oyamaguchi et al Issued: Dec. 29, 1992

Tacky Toner Transfer Method Xerox Disclosure Journal R. C. Vock Vol. 3, No. 4, p. 273 (July/August 1978)

Thermal Ink Jet Printing in an Indirect Marking System Xerox Disclosure Journal Bruce J. Parks et al. Vol. 16, No. 6, pp. 349–350 (November/December 1991)

The relevant portions of the foregoing patents are hereby incorporated by reference, and may be briefly summarized as follows:

U.S. Pat. No. 3,013,878 to Dessauer discloses an improved method and apparatus for transferring and fixing a xerographic powder image on a support. Specifically, the patent discloses an electrostatic latent image formed on a sheet of insulating material in surface contact with a xerographic plate to form a reverse reading latent image thereon. The electrostatic latent image on the material is then developed to form a reverse reading powder image. While the xerographic powder image is adhered to the insulating material it is "tackified", meaning that the individual powder particles are softened so that they coalesce, becoming sticky, but not extending beyond the boundary of the developed latent image pattern. While in the tackified condition, the final support material is superposed on the tackified image and then uniformly pressed into intimate surface contact therewith, so that the application of pressure causes the tackified powder material to flow into the interstices of the support material and bond therewith. Moreover, relatively little bonding occurs between the tackified powder and the surface of the insulating material. A similar process is disclosed by Vock in the Xerox Disclosure Journal, Vol. 3, No. 4, p. 273 (July/August 1978).

U.S. Pat. No. 3,374,769 to Carlson teaches an apparatus employing an intermediate belt to which is transferred a developed image, where it is subsequently heated to tackify the transferred image and then transferred to a sheet of paper. The intermediate belt is transparent, allowing heat to be applied, by reflectance, to both sides of the powder image previously transferred thereto.

U.S. Pat. No. 3,591,276 to Byrne describes a method and apparatus employing an elastomeric intermediate transfer member After developing a latent electrostatic image using conventional methods, the image is transferred to the elastomeric member under pressure to capture the developed powder image. Subsequently, the image is re-transferred to a paper support material by heat and pressure. Moreover, the patent discloses that the paper support material may be preheated, or alternatively heat may be applied at the contact transfer nip, to facilitate re-transfer of the image to the support material.

U.S. Pat. No. 3,794,418 to Makino et al. teaches an imaging system employing an insulating web. More specifically, the insulating web is charged to opposite polarities on either side thereof, with one side being brought into contact with a photoconductive layer, while simultaneously exposing the photoconductive layer to a light-and-shadow image. Subsequently, the electrostatic image formed by this process is developed by application of toner particles, or the electrostatic image may be subsequently transferred to another member before development.

U.S. Pat. No. 3,848,204 to Draugelis et al describes an apparatus in which a developed image of electrostatically charged particles is transferred from an image bearing member to a sheet of support material, while a substantially constant potential difference is maintained between the image bearing member and a sheet support means. The potential difference attracts the developed particles to the sheet of support material secured to the support means.

U.S. Pat. No. 4,195,927 to Fotland et al. discloses an electrophotographic system employing double image transfer. Here, a photoconductive member is charged and exposed to form a latent electrostatic image, which is then transferred to a drum with a durable dielectric coating. The latent electrostatic image is subsequently developed and transferred by pressure to a recording medium with or without simultaneous pressure fixing.

U.S. Pat. No. 4,267,556 to Fotland et al. describes the process of electrostatic transfer printing utilizing an ion emitting print head, where an image is formed on a cylindrical dielectric member by means of an ion source. Subsequently, the image is toned and pressure-transferred to a sheet of paper which is passed between the cylindrical dielectric member and a transfer roller. The patent further describes the possible use of a mesh screen adjacent to the dielectric cylinder to neutralize residual charge remaining on the surface thereof. U.S. Pat. No. 4,365,549 to Fotland et al., a continuation of the previously described patent, further discloses the characteristics of the ion generating means, a multiplexed matrix of control and driver electrodes, as well as, the potential use of a scraper blade to clean the surface of the dielectric member subsequent to image transfer. Specifics of the dielectric surface employed by the Fotland et al. patents can be found in U.S. Pat. No. 4,518,468.

U.S. Pat. No. 4,373,799 to Snelling et al. discloses a multi-mode printing machine capable of printing electrophotographically or electrographically. In either, or both modes, electrostatic charge is transferred to a dielectric sheet which is subsequently developed to form an image thereon. In the electrographic mode, a sheet width stylus array is used to selectively transfer ions to the surface of the dielectric sheet.

U.S. Pat. No. 4,427,285 to Stange teaches a direct duplex printing apparatus which utilizes a pair of pre-fuser transport rolls to "tack" unfused images to a copy sheet. The fuser comprises a pair of heated soft fuser rolls, operating at slightly lower temperature due to the tacking achieved by the pre-fuser treatment.

U.S. Pat. No. 4,448,872 to Vandervatk describes a duplex electrographic imaging method and apparatus utilizing simultaneous transfixing of toner images to opposite sides of a receptor medium using high pressure alone. After developing a latent electrostatic image on an image roll, the image may be transferred, by direct contact, to a transfer roll. Subsequently, a second image may be developed on the image roll. Upon passing a receptor sheet between the two rolls, the image from the imaging roll is transferred to a first surface thereof, while the image previously transferred to the transfer roll is transferred to the opposite surface thereof.

U.S. Pat. No. 4,935,785 to Wildi et al. discloses a fuser roll having a surface of an electric material, where, n the surface of the fuser roll may be charged to the same polarity as that of the toner being fused, thereby avoiding the need for fuser oils.

U.S. Pat. No. 5,087,946 to Dalai et al. describes a fuser roll including a hollow cylinder having a relatively thin wall, wherein the wall is formed of a plastic composition with a conductive fiber filler. The conductive fiber filler forms a heating element within the thin wall of the fuser roll, as well as providing mechanical reinforcement thereto. Hence, the mass of the fuser roll is reduced, requiring less energy and resulting in an "instant-on" fuser.

U.S. Pat. No. 5,168,289 to Katakabe et al. discloses a recording apparatus that employs an ink sheet, coated with a thermoplastic ink, to selectively deposit an image onto an intermediate transfer drum. The intermediate transfer drum is then advanced so as to bring the thermoplastic ink, which was deposited on a silicon elastomer layer on the surface of the drum, into contact with recording paper. The patent further describes the transfer to the recording paper as being achieved while the ink remains above its melting point. As described beginning at col. 7, line 28, a halogen lamp is used to radiate the intermediate transfer surface just prior to contact with the recording paper. Multicolor images are formed on the intermediate transfer drum in a superimposed manner while the halogen lamp remains off, and are then transferred to the recording sheet by turning the lamp on in the presence of the recording sheet to effect transfer thereto.

U.S. Pat. No. 5,175,568 to Oyamaguchi et al. teaches an image forming process which utilizes a recording medium having the characteristic of a decrease in the receding contact angle when heated. Utilizing this characteristic the image forming process may be described with respect to FIG. 8 (see col. 18 line 22 through column 19, line 4). Briefly, the recording medium is selectively heated so that the heated areas attract a solid ink which has been heated above its melting temperature, thus "developing" the heated regions only. The solid ink image is then transferred to a recording sheet while the ink is still soft, to form a visible image thereon. After transfer, the latent image remaining on the recording medium is erased by heating the recording medium with an infrared lamp.

In the Xerox Disclosure Journal publication by Parks et al. (Vol. 16, No. 6, pp. 349–350 (November/December 1991)), the use of a thermal ink jet marking head is disclosed whereby the ink image is first deposited on an intermediate transfer drum or similar media. Subsequently, the ink image is transferred to a copy sheet.

In accordance with the present invention, there is provided a recording apparatus for producing an image on a recording sheet. The apparatus comprises an intermediate member, marking means for depositing marking material on an outer surface of said intermediate member to form an image thereon, a heater, in communication with an internal surface of said intermediate member, for heating said intermediate member so as to cause the tackification of the charged marking material deposited on the outer surface thereof, and means, defining a nip with the outer surface of said intermediate member, for transferring the tackified marking material image to the recording sheet passing through the nip defined by said intermediate member and said transferring means, whereby the tackified marking material image is cooled upon contact with the recording sheet to become permanently fixed to the surface of the recording sheet.

In accordance with another aspect of the present invention, there is provided a duplex recording apparatus for producing images on both sides of a recording sheet. The apparatus comprises first and second imaging systems. Each imaging system including an intermediate member, marking means for depositing marking material on an outer surface of the intermediate member to form an image thereon, and a heater, in communication with an internal surface of said intermediate member, for heating said intermediate member so as to cause a coalescence and tackification of the charged marking material deposited on the outer surface thereof. The apparatus further comprises means, defining a nip between the first and second intermediate members, for forcing said first and second intermediate members into contact with the respective sides of a recording sheet passing through the nip, so as to transfer the tackified marking material images on said first and second intermediate members to the respective sides of the recording sheet, thereby permanently fixing the tackified images thereto.

In accordance with yet another aspect of the present invention, there is provided a method for producing an image on a recording sheet, comprising the steps of: a) non-interactively generating a developed image of charged marking particles on an outer surface of an intermediate member; b) heating at least a portion of the interior of said intermediate member so as to cause the tackification of the marking particles; and c) contacting the outer surface of said intermediate member with the recording sheet to transfer the tackified marking material to the recording sheet.

The present invention has the advantage of a fixed image forming gap, where the latent and/or developed images are produced on the intermediate member, which enables the printing device to be specifically tailored without having to allow for a wide range of recording media that pass through the gap in common electrostatic printing machines. A further advantage of the present invention is that the heat applied to the endless intermediate member is used to heat only the marking particles contained on the surface of the member. This avoids the need for additional energy to heat the recording sheet passing through the transfer nip, and/or subsequent fusing of the marking material transferred to the recording sheet to achieve complete fixing to the sheet. Yet another advantage of the present invention is the elimination of electrostatic fields as the method of transferring the marking particles to the surface of the recording sheet. Not only does this eliminate an energy intensive corona element, but it also improves the reliability with which the marking particles can be transferred to textured or wrinkled recording sheets, for example, recording sheets being subjected to multiple pass duplex imaging.

BRIEF DESCRIPTION OF THE DRAWINGS

FIGS. 3A and 3B are illustrations of the heated intermediate roll imaging process employing direct electrostatic printing as the marking mechanism;

FIG. 5 is an illustration of a cross-section intermediate member; and

FIG. 6 is an illustration of a multicolor heated intermediate roll imaging process configuration suitable for an ionographic printing process.

The present invention will be described in connection with preferred embodiments, however, it will be understood that there is no intent to limit the invention to the embodiments described. On the contrary, the intent is to cover all alternatives, modifications, and equivalents as may be included within the spirit and scope of the invention as defined by the appended claims.

DESCRIPTION OF THE PREFERRED EMBODIMENT

Figure 1:
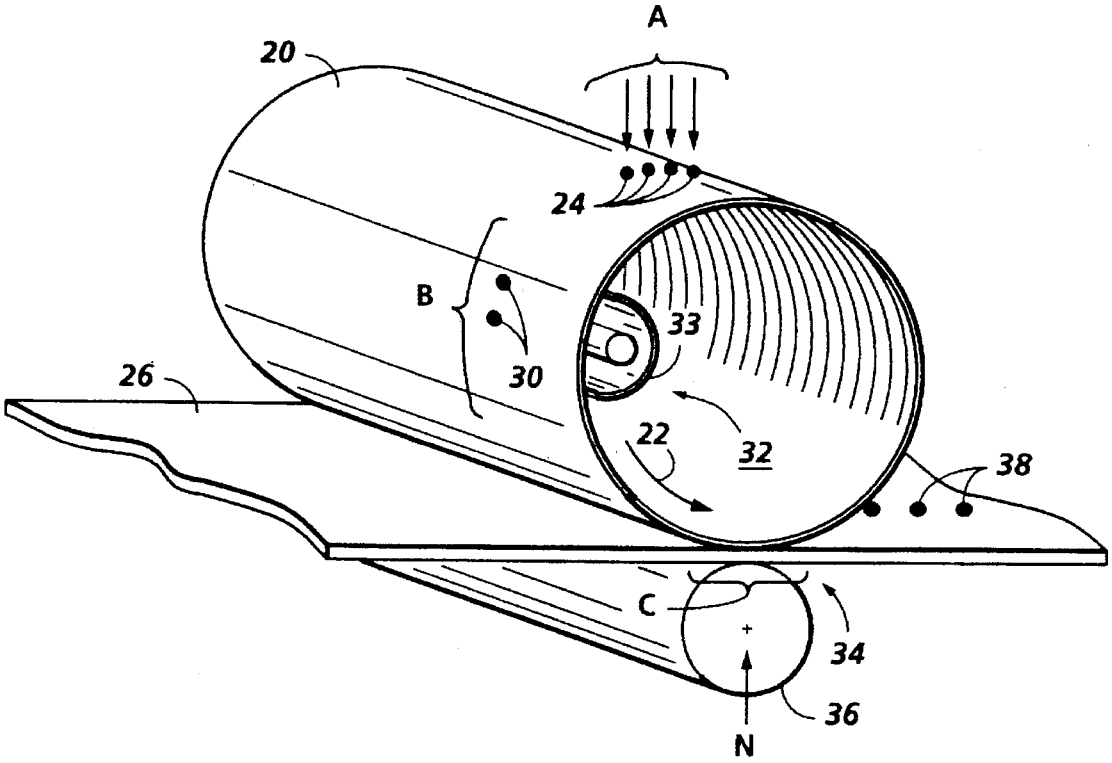
FIG. 1 is a schematic illustration of the various processing stages employed in the present invention.

For a general understanding of the heated intermediate roll imaging process which forms the basis of the present invention, reference is made to the drawings. In the drawings, like reference numerals have been used throughout to designate identical elements. FIG. 1 shows the various processing stages which would be employed to carry out the heated intermediate roll imaging process of the present invention. Generally, intermediate member 20 is the primary element of the imaging system. When rotated in the direction represented by arrow 22, the intermediate member will pass through three stages: A) image deposition; B) image liquefaction or tackification; and C) image transfer/fusing (transfixing).

In the imaging process, intermediate member 20 is first advanced to image deposition stage A. Numerous alternative marking processes may be utilized to deposit marking materials or particles 24 on the surface of member 20 within deposition stage A. For example, indirect or interactive marking techniques may be used, where an electrostatic latent image is first deposited on the surface of the member and subsequently developed with charged marking particles suspended in a carrier which contacts the charged surface. Examples of indirect marking processes include: basic xerographic techniques commonly known to employ photoconductive members which dissipate charge in response to light images; ionographic techniques such as those described by Maczuszenko et al. in U.S. Pat. No. 4,619,515 or by Gundlach et al. in U.S. Pat. No. 4,463,363; and pyroelectric methods such as taught by Snelling in U.S. Pat. No. 5,185,619, hereby incorporated by reference for its teachings. Furthermore, direct or non-interactive marking techniques may be used to deposit marking particles 24 on the surface of member 20. Included in the non-interactive marking methods are: direct electrostatic printing, as described by Levy et al. in U.S. Ser. No. 07/808,243, hereby incorporated by reference for its teachings; selective transfer development, as described by Gundlach in U.S. Pat. No. 2,968,552, hereby incorporated by reference for its teachings; pyroelectric direct marking, as described by Snelling in U.S. Pat. No. 5,153,615 which is also hereby incorporated by reference in the instant specification; hot-melt ink jet techniques using an apparatus similar to that described in the Xerox Disclosure Journal by Parks et al. (Vol. 16, No. 6, pp. 349–350 (November/December 1991), previously incorporated by reference; and acoustic ink printing, as described by Quate et al. in U.S. Pat. No. 4,697,195 and U.S. Pat. No. 4,745,419, both of which are hereby incorporated by reference in the present specification.

Irrespective of the marking technique used at the image deposition stage, the result will be a developed image comprised of regions of marking particles, produced in response to original image data which is understood to have been an input to one of the previously described marking processes. Subsequently, marking particles 24, present on the surface of the intermediate member, are advanced through image liquefaction stage B. Within stage B, which essentially encompasses the region between when the marking particles contact the surface of member 20 and when they are transferred to recording sheet 26, the particles 30 are transformed into a tackified or molten state by heat which is applied to member 20 internally. Preferably, the tackified marking particle image is transferred, and bonded, to recording sheet 26 with limited wicking by the sheet. More specifically, member 20 includes a heating element, 32, which not only heats the internal wall of the intermediate member in the region of transfix nip 34, but because of the mass and thermal conductivity of the intermediate member, generally maintains the outer wall of member 20 at a temperature sufficient to cause the marking particles present on the surface to melt. As an alternative, intermediate member 20 may be a "instant on" device as disclosed by Dalai et al. in U.S. Pat. No. 5,087,946 or a tubular heat roller formed from a ceramic resistor material having a positive temperature coefficient of resistance by Yuan in U.S. Pat.

No. 5,191,381, issued Mar. 2, 1993 and hereby incorporated by reference. The marking particles on the surface, while softening and coalescing due to the application of heat from the interior of member 20, maintain the position in which they were deposited on the outer surface of member 20, so as not to alter the image pattern which they represent.

During liquefaction, or tackification, of the marking particles placed on the outer surface of member 20, the member continues to advance in the direction of arrow 22 until the tackified marking particles, 30, reach transfixing stage C. At transfix nip 34, the liquefied marking particles are forced, by a normal force N applied through backup pressure roll 36, into contact with the surface of recording sheet 26. Moreover, recording sheet 26 may have a previously transferred toner image present on a surface thereof as the result of a prior direct or indirect imaging operation. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfix nip the tackified marking particles wet the surface of the recording sheet, and due to greater attractive forces between the paper and the tackified particles, as compared to the attraction between the tackified particles and the liquid-phobic surface of member 20, the tackified particles are completely transferred to the recording sheet as image marks 38. Furthermore, as the image marks were transferred to recording sheet 26 in a tackified state, they become permanent once they are advanced past transfix nip and allowed to cool below their melting temperature. The transfixing of tackified marking particles has the further advantage of only using heat to pre-melt the marking particles, as opposed to conventional heated-roll fusing systems which must not only heat the marking particles, but the recording substrate on which they are present. Hence, it is anticipated that the energy consumed by heater 32 will be less than that which a comparable fuser roll heater would consume, equally important, if the image receiver substrate paper moisture will be driven from it will less curl result.

Figure 2:
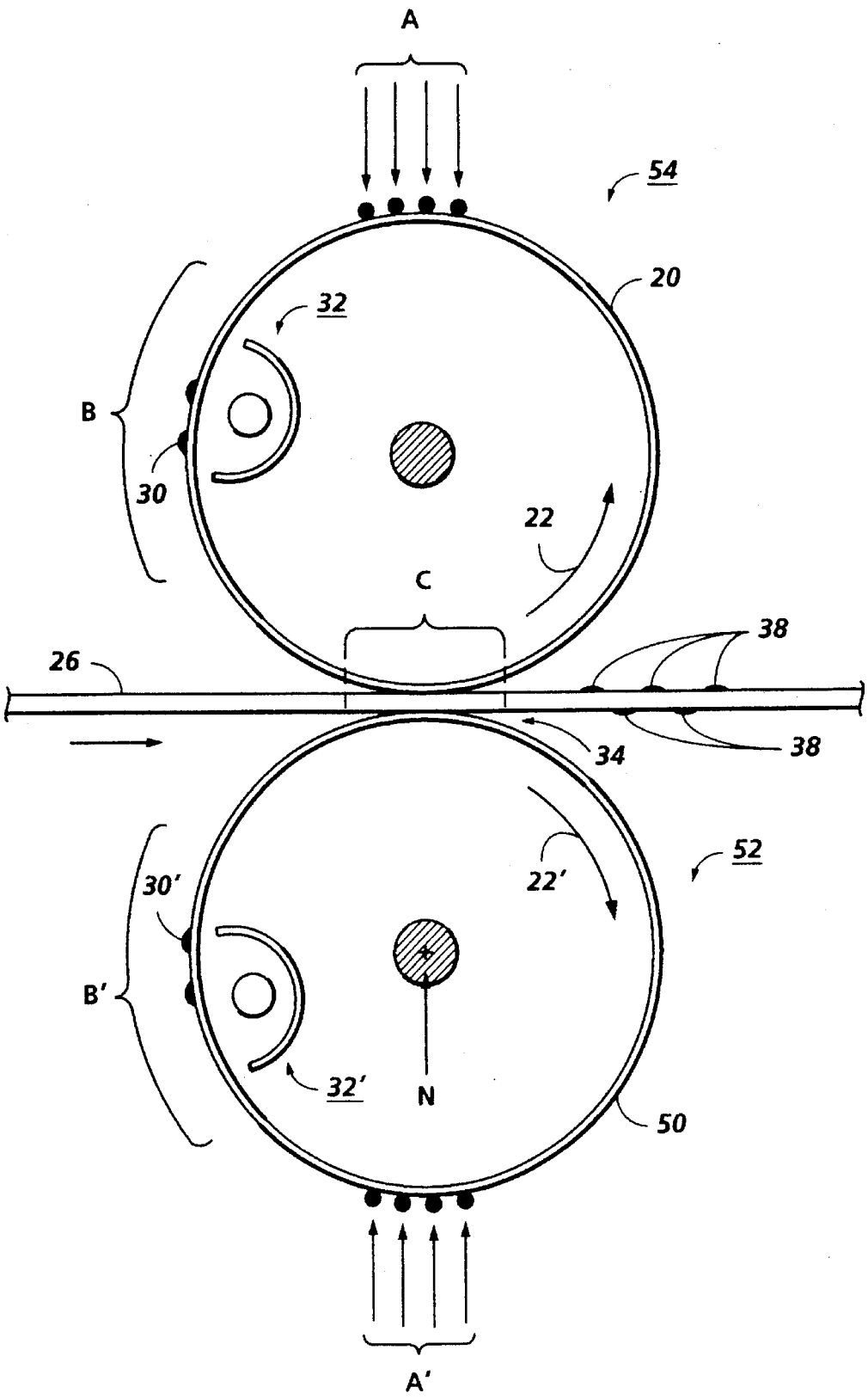
FIG. 2 is a schematic illustration of a single-pass duplex imaging embodiment utilizing the heated intermediate roll imaging process.

Referring next to FIG. 2, which illustrates a duplex embodiment of the present invention, a pair of intermediate members 20 and 50 are used to simultaneously deposit tackified marking particles on each side of a recording sheet 26 passing through common transfix stage C. The duplex-side imaging system, generally depicted in the lower half of FIG. 2 by reference numeral 52, functions in the same manner as was previously described with respect to the simplex-side fuser roll imaging apparatus of FIG. 1. The corresponding image deposition and liquefaction stages, are indicated by reference letters A' and B', respectively. Furthermore, to achieve a constant normal force within transfix nip 34, it would be desirable to maintain the duplex side imaging system 52 as a single subsystem which could be biased against the simplex side imaging system 54 by a normal force N applied in an upward direction. Hence, the addition of a second, inverted, imaging system incorporating the fuser roll imaging process would allow simultaneous duplex imaging of each recording sheet.

Turning now to a specific example of the use of direct marking techniques in conjunction with fuser roll imaging, FIGS. 3A and 3B schematically illustrate a printing apparatus incorporating direct electrostatic printing with an embodiment of the present invention. Although a lesser known form of electrostatic printing, Direct Electrostatic Printing (DEP) differs from the xerographic form, in that, the toner or developing material is deposited directly onto a target substrate in the image configuration, rather than in response to a latent electrostatic image already present on the substrate. This type of printing device is disclosed by Pressman et al. in U.S. Pat. No. 3,689,935, issued Sep. 5, 1972 as well as by Levy et al. in U.S. Ser. No. 07/808,243, both being incorporated herein by reference. In general, this type of printing device uses electrostatic fields associated with addressable electrodes for allowing passage of developer material through selected apertures in a printhead structure.

Referring to FIGS. 3A and 3B, DEP apparatus 110 includes a developer delivery or donor system generally indicated by reference numeral 112, a printhead structure 114 and a backing electrode structure or intermediate member 116. Developer delivery system 112 comprises a donor roll structure, which is preferably coated with Teflon-S™ which is spaced from the printhead. The developer preferably comprises any suitable insulative non-magnetic toner/carrier combination having Aerosil™ and zinc stearate contained therein. The toner or marking particles 118 may be charged positively or negatively, and will be assumed to be negatively charged for purposes of this disclosure.

Printhead structure 114 includes a layered member having an electrically insulative base member 120 which may be fabricated from a polyamide film, and which may be clad on one side thereof with a continuous conductive electrode or shield 122 of aluminum. On the opposite side of base member 120 is a segmented conductive control electrode 124 which is also fabricated from aluminum. The printhead structure 114 is positioned in the printing device such that shield electrode 122 faces donor roll 112.

A plurality of holes or apertures 126 (only one of which is shown) approximately 0.007 inch in diameter are provided in the layered member in a pattern suitable for use in recording information. The apertures form an electrode array of individually addressable electrodes. A preferred aperture array is disclosed by Schmidlin in U.S. Pat. No. 4,860,036, issued Aug. 22, 1989, and is hereby incorporated by reference. Movement of the charged toner to the printhead structure is effected through the application of a DC biased AC peak voltage of about 550 volts with a DC bias of +40 volts. This bias is provided via voltage source 113.

With a voltage applied to shield and zero volts applied to an addressable electrode, toner 118 is propelled through the aperture associated with that electrode. The apertures extend through the base 120 and the conductive layers 122 and 124. Conversely, with a negative 350 volts applied to an addressable electrode via voltage source 115, toner is prevented from being propelled through the aperture. Hence, image intensity can be varied by adjusting the voltage on the control electrodes between 0 and minus 350 volts. Addressing of the individual electrodes can be effected in any well known manner using electronically addressable printing elements which are responsive to signals generated by an Electronic Subsystem (ESS) 78.

In the present invention, the addressing of the electrodes is synchronized with the advancement of intermediate member 20. As depicted in FIG. 3A, the intermediate member interior wall forms electrode 116 and, while not limited to such a configuration, preferably has an arcuate shape. The electrode 116 may also include a dielectric layer 128 interposed between the conductive wall or electrode 116 and the printhead 114. During printing electrode 116 is electrically biased to a DC potential of approximately +300 volts via a DC voltage source 130 for the purpose of attracting the toner particles moved through the apertures toward electrode 116.

A pulsed DC or DC biased AC voltage is applied to the shield electrode structure 122 via voltage source 132. The voltage applied to the shield electrode structure is at the same frequency as the AC voltage applied to the toner supply but is approximately 180° out of phase therewith. The pulsed DC voltage is negative to coincide with the positive cycle of the AC voltage applied to the donor roll thereby establishing an electrostatic field about the shield electrode. Thus, the voltage applied to the shield electrode reduces the fringe field between the shield and control electrodes and increases the field between the toner supply (donor) and the shield. This causes wrong sign toner to be attracted to the shield electrode which is on the toner supply side of the printhead rather than to the control electrode side of the printhead. The natural AC jumping of toner occurring between the donor and the shield electrode prevents buildup of toner particles around the printhead apertures.

In the printing system depicted in FIG. 3A and generally indicated by reference numeral 80, electrode 116 is represented as the rotatably supported intermediate member 20 hereinbefore disclosed as a cylinder or roller. Intermediate member 20 serves as a DEP image receiver on which images are deposited in image configuration by means of a DEP printhead structure 82 of the type described in connection with FIG. 3B. Transfix or backup pressure roller 36, supported in pressure engagement with the intermediate member, serves to effect the simultaneous transfer and fixing of the the toner images on a recording sheet 26 which preferably comprises a sheet of plain paper. Intermediate member 20 could be fabricated as a conductive cylinder or one coated with a suitable insulator material. Preferably, a conductive intermediate member is used to minimize image spreading or "blooming" due to the deposition of charged toner particles, and also to avoid the need for corona neutralizing devices that might be required if an insulating coating is used.

Figure 4:
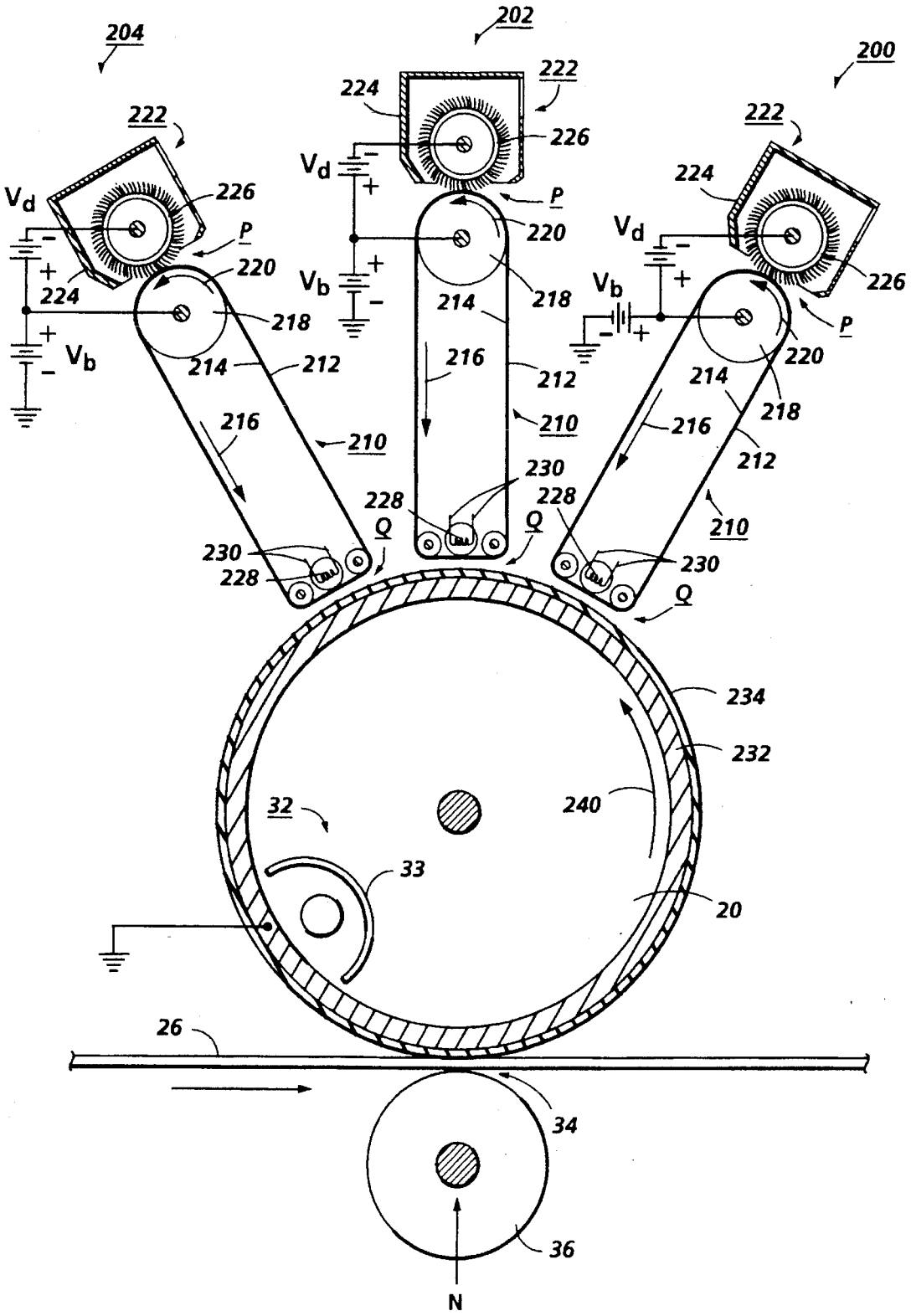
FIG. 4 is an illustration of a multicolor heated intermediate roll imaging process employing a plurality of pyroelectric direct marking mechanisms.

In another alternative embodiment employing the heated intermediate roll process, as depicted in FIG. 4, a multicolor printing apparatus may utilize a common intermediate member 20 and a plurality of pyroelectric marking devices, each depositing a different color on the intermediate member. As described by Snelling in U.S. Pat. No. 5,153,615, issued Oct. 9, 1992 and incorporated herein by reference, each marking device 200, 202, and 204 includes a donor belt 210, having a pyroelectrically responsive outer layer 212 and a conductive base layer 214. Belt 210 is rotated in the direction indicated by arrow 216 through vanous processing stations by drive roll 218. Initially, roll 218 is rotated in the direction of arrow 220 to move belt 210 through donor loading station P. Loading station P employs a developer unit, indicated generally by reference numeral 222, having developer housing 224 for maintaining a supply of development material therein. The developer material generally comprises magnetic carrier granules with charged toner particles adhering triboelectrically thereto. Developer unit 222 is preferably a magnetic brush development system where the developer material is moved through a magnetic flux field causing a brush 226 to form. The surface of pyroelectric layer 212 is toned by bringing the layer into contact with a biased magnetic brush 226. The brush is biased as indicated by a direct current potential $V_d$, referred to as the donor loading voltage. Moreover, donor loading voltage $V_d$ may be applied via conductive drive roll 218 or other suitable commutative method in contact with conductive base layer 214. In this manner, the toner particles on magnetic brush 226 are electrostatically attracted to belt 210, thereby forming a uniform toner layer on the surface of layer 212.

Belt 210, having been previously coated with a layer of charged toner particles, is rotated in the direction of arrow 216 to move the toner covered surface thereon to marking station Q, generally referred to in FIGS. 1 and 2 as image deposition stage A. Coincident with the rotation of belt 210, intermediate member 20 is advanced in the direction indicated by arrow 230. Intermediate member 20 may be either a rigid roll or an endless belt having a path defined by a plurality of rollers in contact with the inner surface thereof. As depicted in FIG. 4, intermediate member 20 is preferably a dual layer roll having an inner core 232 made of a rigid, high thermal conductivity material, such as aluminum, so that heat applied to the inside thereof by heater 32, preferably a common incandescent-type fuser heater, is rapidly conducted to the upper, resilient surface layer 234. Heater 32 further includes a radiation deflection shield 33 that would focus the emitted radiation to a localized area around or slightly upstream of the transfix nip so as to prevent thermal interactions with the pyroelectric donor belt 210 at the marking stations Q. Surface layer 234 may be any commonly known coating which resists the adhesion of solid and tackified toner particles, yet is capable of conducting heat from the inner core of the intermediate member. For example, possible surface layers would include Teflon™ (including TFE or FEP fluorocarbon polymers), Viton™ (a fluoroelastomer of vinylidene fluoride and hexafluoropropylene), and equivalent polymers exhibiting no-stick, chemically resistive properties.

The selective transfer of toner particles from the surface of belt 210 to intermediate member 20 is accomplished through the use of thermal print stylus 228, which is preferably an array such as may be used for the production of prints on thermally sensitive paper. The print stylus, or alternatively a resistive ribbon layer within belt 210 which is energized by a stylus, selectively heats conductive base layer 214 of belt 210. Heating thermally conductive base layer 214 results in the rapid heating of pyroelectric layer 212 which generates an opposite polarity electrostatic charge on the surface thereof. The individual thermal elements of stylus 228 are driven by an electronic subsystem (ESS) (not shown), via input lines 230, in accordance with imaginal data received from any suitable image raster generation system. Thereafter, belt 210 continues to be rotated by drive roll 218, to return the region of the belt which was most recently used as a donor of marking particles to toner loading station P for replenishment of toner in the depleted regions, thereby reestablishing the uniform toner layer on the surface of belt 210.

Subsequent to receiving toner for the color image to be produced by pyroelectric marking device 200, the intermediate member 20 continues rotation in the direction indicated by arrow 240 so that it subsequently passes beneath the marking stations Q of pyroelectric marking devices 202 and 204, each applying toner particles having a color distinct from the other marking devices. For example, pyroelectric marking devices 200, 202, and 204 may respectively deposit cyan, magenta and yellow toner on the surface of intermediate member 20 as it rotates. Because each of the individual pyroelectric marking devices are physically separated from intermediate member 20 by a small yet controlled gap, preferably in the range of about 0.25 mm to about 0.5 mm, the deposition of the multiple toners on the intermediate member can be accomplished without affecting subsequent toner deposition or transfixing. In this way, a multicolor image can be "built-up" on a single pass of the intermediate member 20 and immediately transfixed to the surface of recording sheet 26.

It is further believed that additional color marking stations can be added to the multicolor system depicted in FIG. 4 to provide a black toner capability as well. Moreover, a combination of one or more of the aforedescribed direct or indirect marking techniques may be employed with the present invention. For example, it is conceivable that an indirect marking technique, such as an ionographic technique, may be used to apply black toner to the intermediate member in conjunction with a direct marking technique, such as the pyroelectric imaging process previously described, which would be used to provide one or more additional toner colors to be annotated to the black image on the intermediate member. In this manner highlight or multicolor images could be produced. Similarly, it is conceivable that a printing machine employing an indirect marking process to generate a single color image on a recording sheet may employ the aforedescribed heated intermediate member imaging techniques to annotate such an image with additional or different color image information via the heated fuser roll.

Illustrated in FIG. 6 is a schematic representation of one possible a multicolor printing apparatus intermediate member 20 machine configuration suitable for an ionographic printing process. Intermediate member 20 is employed as an electroreceptor. It is preferred that intermediate member comprises a two layer structure which can be optional mounted onto a rigid member 5 (as shown in FIG. 6). The substrate layer 6 has a thickness between 0.1 mm and 1.0 mm and a resistivity between $10^6$ ohm-cm and $10^{11}$ ohm-cm at temperatures between 130° C. to 150° C. A insulating top layer 8 has a thickness less than 100 microns, a dielectric constant between 10 and 1.0, and a resistivity between $10^{12}$ ohm-cm and $10^{14}$ ohm-cm at temperatures between 130° C. to 150° C. The top layer also has an adhesive release surface. Also, it is preferred that both layers have matching hardness between 50 durometer and 80. Preferably, both layers are composed of Viton™ which can be laminated together. An advantageous feature of the composite of intermediate member as describe above is that the combined thickness is great enough to allow conformity to texture paper or other image receiver, while the insulating top layer has a dielectric equivalent thickness of about 9 to 20 microns, giving a unit area capacitance of $7\times10^{-11}$ S/cm$^2$ or 70 pS/cm$^2$. This allows a latent image voltage contrast of no more than 350 volts, for a charge density of at least 25 nC/cm$^2$.

Intermediate member 20 moves around tensioning rollers 2*a* and 2*b* in the direction indicated by arrows 3. Intermediate member 20 receives a first latent image to be developed with a first color from ionographic or ionic projection writing head 7, which latent image is then developed with a first developer at one of a plurality of development stations 9*a*, 9*b*, 9*c*, and 9*d*; FIG. 5 illustrates development with station 9*a* engaged. Development stations 9*a*, 9*b*, 9*c*, and 9*d* employ a noninteractive marking technique to deposit marking particles on the surface of intermediate member 20. The marking particles are transformed into a tackified or molten state by heat which is applied to intermediate member 20 internally. Intermediate member 20 includes a plurality of heating elements 32*a*, 32*b*, 32*c*, and 32*d* which not only heats the internal wall of the intermediate member in the region, but generally maintains the outer wall of member 20 at a temperature sufficient to cause the marking particles present on the surface to melt, preferably heat controller 21 keeps intermediate member temperature between the temperatures of 130° C. to 150° C. An advantageous feature of maintaining the between temperatures of 130° C. to 150° C. is that it enables the development of a second latent image without disturbing the previous developed latent image thereby producing color images with uniform, low noise transfer and low paper curl. It is believe that the developed latent image composed of loose marking particles quickly tackifies to the intermediate member. As the marking particles tackified, the developed latent image flow into greater contact and higher capacitance with the intermediate member, and the charges on the marking particles relax. This, in turn, reduces contributions to blooming by previous developed images, and also reduce tendency of loose toner to shift under high lateral electrostatic fields at the boundaries of the latent image for the next color.

When images of more than one color are desired, the imaging means again moves past ionic projection writing head 7, at which point another latent image is formed on top of the first developed image, and the latent image moves past development stations 9, where it is developed with a second marking particle of a color different from that of the first developer at, for example, development station 9*b*. The second marking particle quickly tackifies to the previous developed latent image. The process is repeated, with the subsequent latent images being developed at development stations 9*c* and 9*d*, until the final full color image has been formed. The full color image moves to transfix to a recording sheet.

At transfix nip 34, the liquefied marking particles of the full color image are forced, by a normal force N applied through backup pressure roll 36, into contact with the surface of recording sheet 26. As the recording sheet passes through the transfix nip the tackified marking particles wet the surface of the recording sheet, and due to greater attractive forces between the paper and the tackified particles, as compared to the attraction between the tackified particles and the liquid-phobic surface of member 20, the tackified particles are completely transferred to the recording sheet. Furthermore, as the full color image image transferred to recording sheet 26 in a tackified state becomes permanent once the full color image advances past transfix nip and allowed to cool.

In recapitulation, the present invention is a method and apparatus for printing which employs a heated intermediate member. The intermediate member first acts as a receptor for marking particles representing an image, whereby the marking particles may be deposited directly or indirectly on the member. The member is then exposed, via an internal heat source, to an elevated temperature sufficient to cause the melting and coalescing of the marking particles. Subsequently, the intermediate member is advanced so as to place the tackified marking particles present on the outer surface thereof into intimate contact with the surface of a recording sheet. The present invention takes advantage of the dimensional stability of the intermediate member to provide a uniform image deposition stage, resulting in a controlled image transfer gap and better image registration. Further advantages include reduced heating of the recording sheet as a result of the toner or marking particles being pre-melted, as well as the elimination of electrostatic transfer of charged particles to a recording sheet.

It is, therefore, apparent that there has been provided, in accordance with the present invention, a method and apparatus for producing a transferable image directly on a fuser-like intermediate member. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A recording apparatus for producing a color image on a recording sheet, comprising:

an intermediate member;

first marking means for depositing marking material of a first color on said intermediate member to produce a marking image thereon;

a heater, in communication with said intermediate member, for heating said intermediate member so as to form a tackified marking image thereon;

second marking means for depositing marking material of a second color on the tackified marking image forming a composite tackified marking image on said intermediate member;

means for transferring the composite tackified marked image to the recording sheet; and first ion generating means for recording an electrostatic latent image on said intermediate member, said first marking means developing the electrostatic latent image with the marking material of the first color to produce a developed image on said intermediate member.

2. The apparatus of claim 1, wherein said ion generating means records a second electrostatic latent image at least partially on the developed image, said second marking means developing the second electrostatic latet image with the marking material of the second color to produce a composite developed image of charged marking particles on the surface of said intermediate member.

3. The apparatus of claim 1, further comprising a heater controller, associated with said heater, for maintaining said intermediated member between the temperatures of 130° C. to 150° C.

4. The apparatus of claim 1, wherein said intermediate member comprises:

a substrate layer; and an insulating top layer coupled to said substrate layer.

5. The apparatus of claim 4, wherein said substrate layer comprises a thickness ranging from about 0.1 mm to about 1.0 mm and a resistivity ranging from about $10^6$ ohm-cm to about $10^{11}$ ohm-cm at temperatures ranging from about 130° C. to about 150° C.

6. The apparatus of claim 4, wherein said insulating top layer has a thickness ranging from about 10 microns to about 100 microns, a dielectric constant ranging from about 10 to about 1.0, and a resistivity ranging from about $10^{12}$ ohm-cm to about $10^{14}$ ohm-cm at temperatures ranging from about 130° C. to about 150° C.

7. The apparatus of claim 4, wherein said substrate layer and said insulating top layer have hardness between 50 durometer to 80 durometer.

8. The apparatus of claim 4, wherein:

said substrate layer comprises a fluoroelastomer of vinylidene fluoride and hexafluoropropylene; and said insulating top layer comprises a fluoroelastomer of vinylidene fluoride and hexafluoropropylene.

9. A method for producing a color image on a recording sheet, comprising:

depositing marking material of a first color on a intermediate member;

heating the marking material deposited on the intermediate member to form a tackified marking image and wherein said heating step comprises maintaining the intermediated member ranging from about 130° C. to about 150° C., and further comprises using an intermediate member having a substrate layer and an insulating top layer coupled therewith and wherein said using step comprises using substrate layer has a thickness ranging from about 0.1 mm to about 1.0 mm and a resistivity ranging from about $10^6$ ohm-cm to about $10^{11}$ ohm-cm; and depositing marking material of a second color at least partially on the marking particles of the first color forming a composite tackified marking image.

10. A method for producing a color image on a recording sheet, comprising:

depositing marking material of a first color on a intermediate member;

heating the marking material deposited on the intermediate member to form a tackified marking image and wherein said heating step comprises maintaining the intermediated member ranging from about 130° C. to about 150° C., said heating step comprises using an intermediate member having a substrate layer and an insulating top layer coupled therewith and wherein said using step comprises using insulating top layer has a thickness ranging from about 10 microns to about 100 microns, a dielectric constant ranging from about 10 to about 1.0, and a resistivity between $10^{12}$ ohm-cm to about $10^{14}$ ohm-cm; and depositing marking material of a second color at least partially on the marking particles of the first color forming a composite tackified marking image.

11. A method for producing a color image on a recording sheet, comprising:

recording an ionographic latent image on an intermediate member;

developing the ionographic latent image with marking material of a first color on the intermediate member;

heating the marking particles deposited on the intermediate member to form a tackified marking image; and depositing marking material of a second color at least partially on the marking particles of the first color forming a composite tackified marking image; and transferring the composite tackified marked image to the recording sheet.

* * * * *